US006948591B2

(12) United States Patent
Scott et al.

(10) Patent No.: US 6,948,591 B2
(45) Date of Patent: Sep. 27, 2005

(54) SUPPORT APPARATUS OR ACCESSORY FOR A LADDER

(76) Inventors: Jon Robert Scott, 32 Erinvale Street, Corinda, Queensland (AU) 4075; Andrew Anthony Richards, 59 Long Street West, Graceville, Queensland (AU) 4075

( * ) Notice: Subject to any disclaimer, the term of this patent is extended or adjusted under 35 U.S.C. 154(b) by 0 days.

(21) Appl. No.: 10/735,529

(22) Filed: Dec. 12, 2003

(65) Prior Publication Data

US 2005/0127254 A1 Jun. 16, 2005

(51) Int. Cl.[7] ..... E06C 7/44

(52) U.S. Cl. ..... 182/201; 248/188.5; 248/188.8; 248/210; 403/109.2

(58) Field of Search ..... 182/200, 201, 182/202, 203, 204, 205; 248/210, 188.8, 248/188.9, 188.5; 403/109.6, 109.1, 109.2, 403/109.3

(56) References Cited

U.S. PATENT DOCUMENTS

| | | | | | |
|---|---|---|---|---|---|
| 974,643 | A | * | 11/1910 | Carlson | 135/25.32 |
| 1,393,536 | A | * | 10/1921 | Hunt | 182/203 |
| 1,609,257 | A | * | 11/1926 | Lazear | 182/205 |
| 3,791,487 | A | * | 2/1974 | Baumann | 182/201 |
| 3,861,500 | A | | 1/1975 | Dempsey | |
| 4,091,893 | A | | 5/1978 | Neal | |
| 4,209,078 | A | * | 6/1980 | Gerber | 182/203 |
| 4,284,172 | A | * | 8/1981 | Cohen | 182/204 |
| 4,423,797 | A | * | 1/1984 | Batten | 182/204 |
| 4,606,432 | A | | 8/1986 | Belt | |
| 4,607,726 | A | | 8/1986 | Davis et al. | |
| 4,802,471 | A | | 2/1989 | Cordell | |
| 5,007,503 | A | | 4/1991 | Sturm | |
| 5,232,067 | A | | 8/1993 | Griffith | |
| 5,273,133 | A | | 12/1993 | Thocher et al. | |

(Continued)

FOREIGN PATENT DOCUMENTS

| | | |
|---|---|---|
| AU | 76 668/81 | 6/1982 |
| CA | 2281309 | 2/2000 |
| GB | 2 124 691 A | 2/1984 |
| GB | 2 300 445 A | 11/1996 |
| GB | 2 316 704 A | 3/1998 |
| WO | WO96/27731 | 9/1996 |
| WO | WO02/059446 A1 | 8/2002 |

OTHER PUBLICATIONS

Jershon, Inc. *Level-Eze Automatic Ladder Leveler*; http://jershon.com.index.html., Aug. 20, 2003.

Black Adda Company, Product *Catalogue & Price List*; http://www.blackadda.com/catalogue.htm, pp. 1-4, Aug. 15, 2003.

*Primary Examiner*—Jonathon Szumny
(74) *Attorney, Agent, or Firm*—Workman Nydegger

(57) ABSTRACT

The present invention relates to a support apparatus or accessory capable of attaching to an article, such as a ladder via mating and locking of a primary attachment member connected to the support and a complementary secondary attachment member securable to the ladder. In a preferred form, the support is an adjustable length support for levelling a ladder on an uneven surface. The adjustable length support comprises a fixed component and a moveable component that moves relative to the fixed component to thereby adjust a length of the adjustable length support. The moveable member is securable at a desired length by a securing means.

16 Claims, 5 Drawing Sheets

U.S. PATENT DOCUMENTS 5,325,936 A 7/1994 Baker
5,335,754 A 8/1994 Gibson
5,423,397 A * 6/1995 Boughner ..... 182/107
5,464,071 A 11/1995 Rice et al.
5,542,497 A 8/1996 Macyszyn
5,551,529 A 9/1996 Molitor
5,678,656 A * 10/1997 Lanzafame ..... 182/205
5,718,306 A * 2/1998 Baker ..... 182/204
5,845,744 A * 12/1998 Beck et al. ..... 182/204
5,950,762 A * 9/1999 George ..... 182/129
6,382,353 B2 * 5/2002 Laug ..... 182/107
6,435,306 B2 * 8/2002 Stoneburg ..... 182/204

* cited by examiner

SUPPORT APPARATUS OR ACCESSORY FOR A LADDER

FIELD OF THE INVENTION

This invention relates to a support apparatus or accessory capable of use with an article such as a ladder. The support apparatus in a preferred form is an adjustable length support for levelling a ladder on an uneven surface.

BACKGROUND OF THE INVENTION

It may be necessary to adjust a length of an article, such as a ladder, when the ladder is located on uneven or on an incline surface. Use of a ladder on such a surface may pose a danger to a person climbing the ladder. In some situations it may be possible to level the contacting surface, for example, if the surface is dirt or gravel. However, levelling a dirt or gravel surface may be time consuming and unstable.

In some situations the surface may not easily be levelled, for example concrete surfaces including steps. In the past, placing wood blocks or other objects as spacers under a ladder leg have been used to adjust the length of one ladder leg to thereby level the ladder. However, using such temporary means tend to be unstable and may be unsafe as the blocks could shift relative to the ladder causing the ladder and user to fall. To overcome this problem, ladders and apparatus for adjusting ladders to be level on uneven or sloping surfaces have been developed.

A levelling apparatus attachable to a ladder to overcome the problems associated with temporary levelling means is described in PCT/AU02/00080. The described levelling apparatus comprises a tubular housing through which an inner leg telescopically moves to thereby adjust the extended length of the inner leg. The tubular housing is attachable to the ladder via a rod that extends at least partially through a rung of the ladder. Although this levelling apparatus provides a means for levelling a ladder, attaching and removing the levelling apparatus from a ladder can be time consuming. Accordingly, a user may leave the levelling apparatus attached to the ladder when not in use, which can lead to damage to the levelling apparatus, for example during transport and storage. Also, leaving the levelling apparatus attached to a ladder requires individual levelling apparatus for each ladder. This can be expensive, in particular in a situation where a person or company has multiple ladders.

SUMMARY OF THE INVENTION

It is an object of the invention to provide a support apparatus or accessory attachable to a ladder, which may alleviate one or more of the limitations of, improves upon, or provides an alternative to the abovementioned background art. The present invention provides a stable, simple and quick means of attaching a support apparatus in particular an adjustable length support, to a ladder and for levelling the ladder on an uneven surface.

In a first aspect, the invention provides a support or accessory apparatus for a ladder or other article including:

(a) a body;

(b) a primary attachment member connected to the body;

(c) a secondary attachment member securable to the ladder; and (d) locking means for retaining the primary attachment member and the secondary attachment member together.

The body may comprises a fixed component to which the primary attachment member is connected and a movable component capable of moving relative to the fixed component.

The fixed component preferably comprises a guiding means for guiding the movement of the movable component.

The guiding means may comprises a housing, channel, bracket or the like.

In one form, the housing comprises an elongate continuous enclosed hollow tube.

The moveable member in one form is an inner member capable of telescopic movement relative to the housing.

The movable member may be secured at a desired position relative to the fixed member by a securing means.

The securing means in one form comprises a securing pin located on the fixed component and a mating aperture located on the moveable component, wherein the securing pin when inserted into the mating aperture secures the moveable member relative to the fixed member.

The primary attachment member may be connected to the body by a fastener.

Preferably, the fastener is a weld, rivet, bolt, screw or adhesive.

The secondary attachment member may be secured to a side rail of the ladder.

The secondary attachment member in one form is secured by a fastener that extends at least through the side rail of the ladder.

The fastener may comprise a rod traversing the ladder from one side rail to another side rail.

The rod in one form is located within an adjacent rung of the ladder.

The primary attachment member and the secondary attachment member preferably engage in a male-female interaction.

The primary attachment member in one form is a peg and the secondary attachment member is a socket.

The primary attachment member in another form is a socket and the secondary attachment member is a peg.

Suitably, the peg is slidable within the socket.

The locking means may comprises one or more fasteners insertable through co-aligned apertures in the peg and the socket.

The locking means may comprise a locking ring or locking pin.

The locking ring in one form comprises a bent portion adapted to be inserted through said socket aperture and securable within the peg aperture to thereby retain the socket peg together.

In a second aspect, the invention provides a ladder assembly comprising:

(i) a ladder, (ii) a support apparatus or accessory comprising:

(1) a body;

(2) a primary attachment member connected to the body;

(3) a secondary attachment member securable to the ladder; and (4) locking means for retaining the primary attachment member and the secondary attachment member together.

The support apparatus may comprises: an adjustable length support, stabilizer, wall guard, hook, shelf, tray, paint can hanger or bucket hanger.

The primary attachment member and the secondary attachment member preferably engage in a male-female interaction.

The primary attachment member in one form is a peg and the secondary attachment member is a socket.

The primary attachment member in another form is a socket and the secondary attachment member is a peg.

The locking means preferably comprises one or more fasteners insertable through co-aligned apertures in the peg and the socket.

The locking means may comprise a locking ring or locking pin.

Although one preferred embodiment of the invention relates to use of the support apparatus with a ladder, it will be appreciated that features of the invention as described for a ladder may also be used for other articles. For example, a suitable article may include an article that requires adjustment of height relative to a surface that the article is located. The invention is particularly suited for use with articles requiring repeated height adjustment, for example an article that is temporarily located on one uneven surface then moved to another surface that may be either uneven or level. Examples of such articles include: ladders (inclusive of step ladders, extension ladders, step-extension ladders and the like), scaffolds, trestles, tables, benches, chairs, sawhorse or like article.

It will also be appreciated that the support apparatus may have uses other than an as adjustable length support. Other uses include, for example, as stabilizers, hooks or wall guards that typically are located at an upper end of a ladder to stabilize the ladder. Also, the apparatus of the invention may constitute an accessory to the ladder such as trays, shelves, paint can hangers, bucket hangers and the like.

Throughout this specification unless the context requires otherwise, the word "comprise", and variations such as "comprises" or "comprising", will be understood to imply the inclusion of the stated integers or group of integers or steps but not the exclusion of any other integer or group of integers.

DESCRIPTION OF THE DRAWINGS

In order that the invention may be readily understood and put into practical effect, preferred embodiments will now be described by way of example with reference to the accompanying drawings wherein like reference numerals refer to like parts.

DETAILED DESCRIPTION OF THE INVENTION

Figure 1:
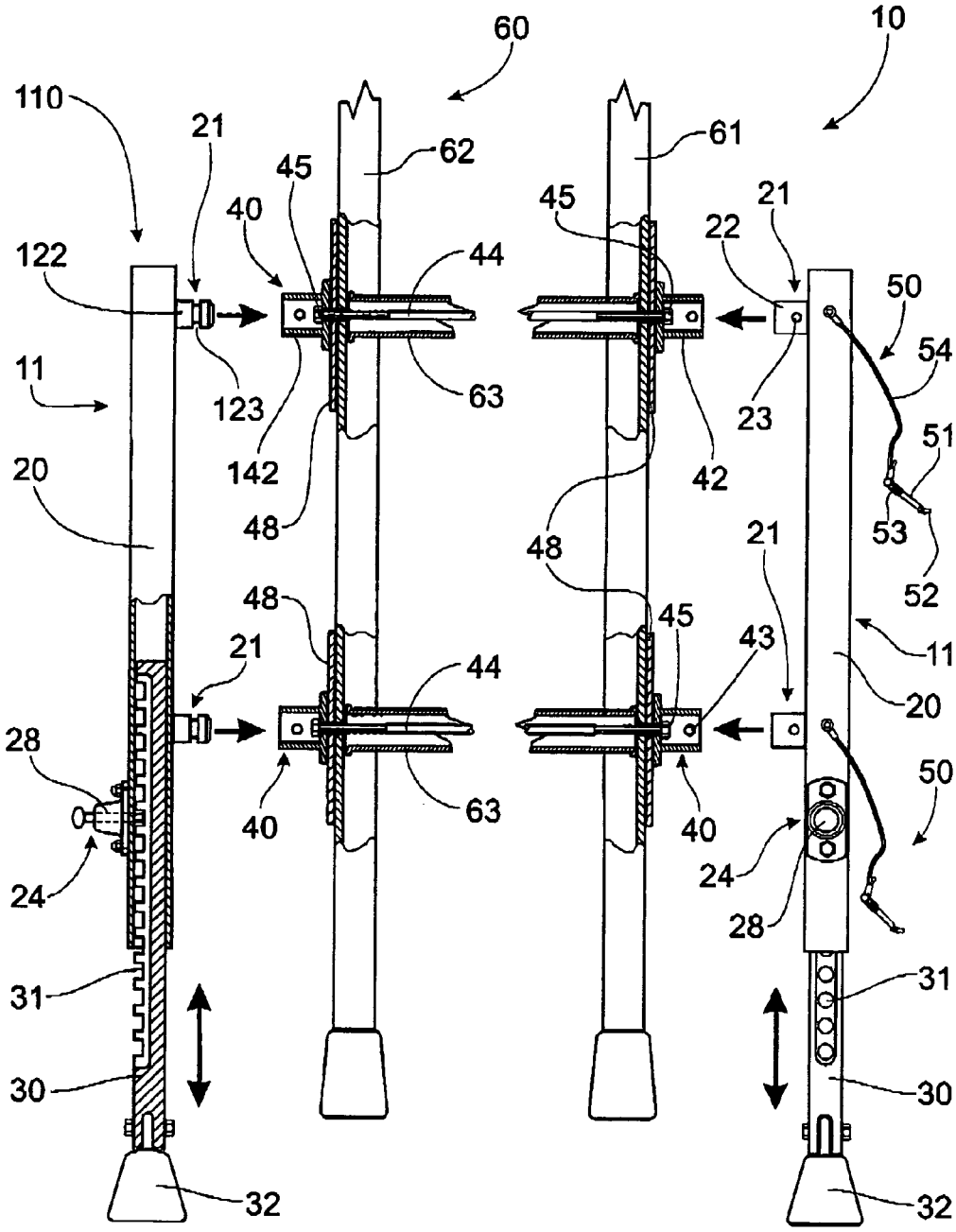
FIG. 1 is a front view showing two embodiments of adjustable length supports being attached to a ladder.

FIG. 1 shows two support apparatus 10 and 110 being attached to an article exemplified as a ladder 60. The support apparatus 10, 110 are shown as adjustable length supports for levelling the ladder 60 on an uneven surface.

The support apparatus 10 comprises two primary attachment members 21 connected to the body 11 by welds. The primary attachment members are shown as pegs 22. Each peg 22 is adapted to mate with a secondary attachment member 40, shown in FIG. 1 as a socket 42, attached to the ladder 60. Socket 42 comprises a hollow interior adapted to mate with peg 22. Peg 22 is shown cylindrical and internally mates with socket 42, which has a complementary shape to that of the peg 22 so that the peg and socket may engage in a male-female interaction.

Peg 22 has a peg aperture 23 that traverses an entire length thereof. Socket 42 comprises two aligned socket apertures 43 located on opposed surfaces of the socket wall. When peg 22 is inserted into the socket 42, the peg apertures 23 and the socket apertures 43 align. A locking means 50 is inserted into the aligned aperture to thereby lock the peg 22 and socket 42 together. The locking means 50 comprises a fastener having a locking pin 51, pivotable locking bar 52 and biased means 53, shown as a coiled spring. In use, the locking means 50 is inserted into the aligned apertures 23, 43 and the pivotable locking bar 52 is pivoted to orientate the locking bar 52 perpendicular to the locking pin 51 to thereby secure the locking means 50 within the aligned apertures 23, 43. The biased means 53 applies a force so that the locking bar 52 is pressed against an adjacent outside part of the socket 42 to thereby secure the locking means 50 in place. To remove the attached adjustable length support 10 from the side rail 61 of the ladder 60, the above process is reversed. An optional cable or cord 54 is attached to the fixed component 20 and locking pin 51 to prevent loss of the locking means 50 when not inserted into the aligned apertures 23, 43.

In another embodiment, the support apparatus 110 comprises two primary attachment members 21 in the form of pegs 122 welded to a fixed component 20 of the body 11. The peg 122 differs from peg 22 by comprising a groove 123 that extends around the circumference of the peg 122. Peg 122 is adapted to slide into the socket 142 that is attached to the ladder 60.

Figure 4:
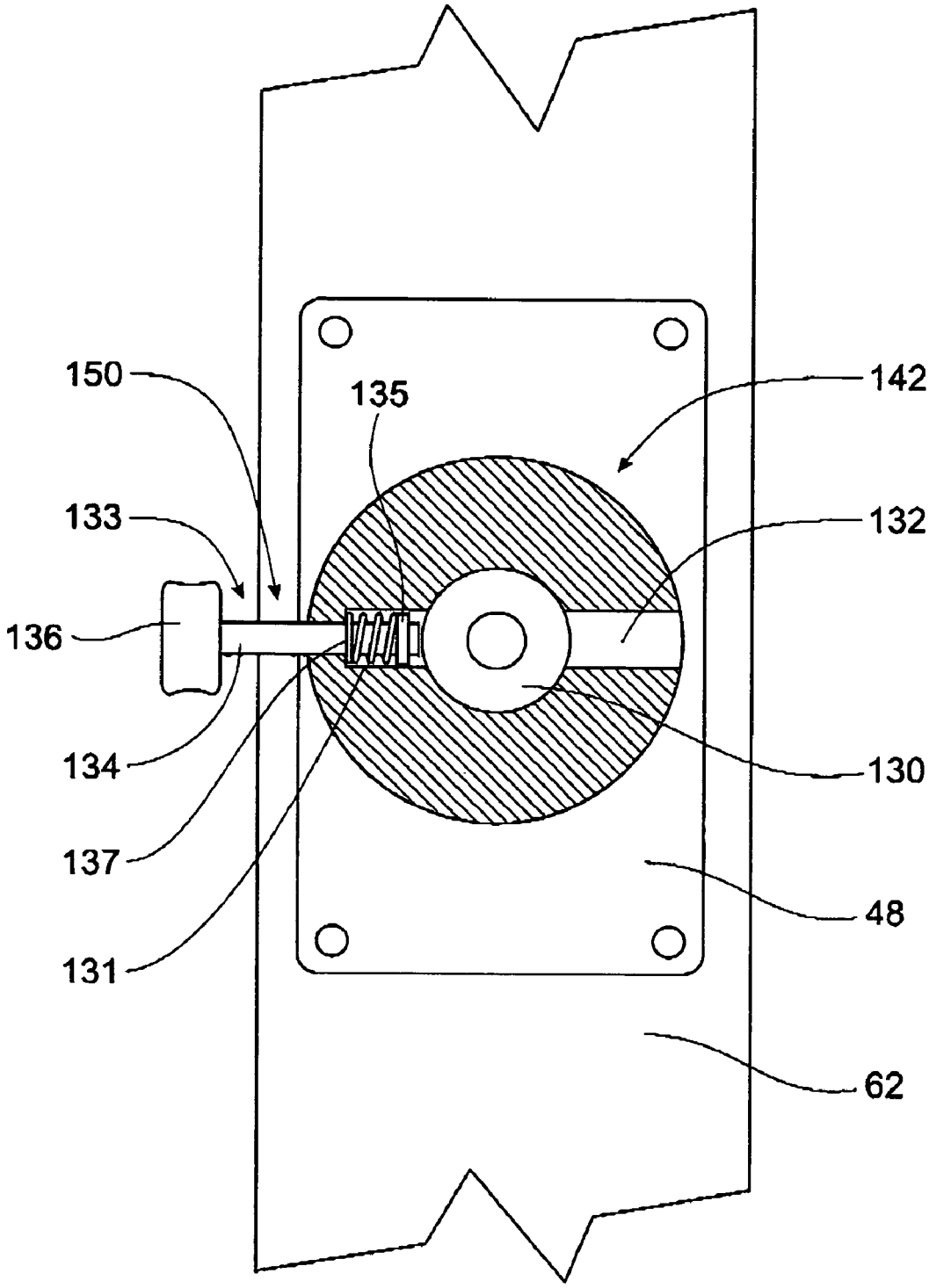
FIG. 4 is a sectional side view of the embodiment of a secondary attachment member attached to a ladder as shown in FIG. 3.

As shown in FIG. 4, socket 142 comprises a hollow interior body 130 for receiving the peg 122, an aperture 131 for housing a fastener in the form of a locking pin 133 of locking means 150 and an aperture 132 for inserting the locking pin 133 into aperture 131. The locking pin 133 comprises a body 134, a collar 135 and a knob 136. Locking pin 133 when located within the socket 142 is biased by coiled spring 137. To assemble the locking means 150, the body 134 and coiled spring 137 are inserted through the aperture 132 and into the aperture 131. An end of the body 134 outwardly extends from the aperture 131 so that the knob 136 may be fastened thereto.

In use, peg 122 is inserted into the hollow interior body 130 of the socket 142 and the locking pin 133 is moved clear of the hollow interior body 130 by pulling on the knob 136. Alternatively, a tapered head of the peg 122 allows peg 122 to be inserted into the hollow interior body 130 and the locking pin 133 is displaced by a force of inserting the peg 122. The groove 123 on the peg 122 aligns with the locking pin 133 once the peg 122 has been inserted into the socket 142. The locking pin 133 retains the peg 122 and the socket 142 together by inserting into the groove 123. The coiled spring 137 applies a force on the locking pin 133 to remain in the groove 123. To remove the peg 122, the process is reversed and the locking pin 133 is pulled out from groove 123 to thereby release the peg 122 from the socket 142.

FIG. 1 also shows an embodiment for attaching the secondary attachment member 40 to the ladder 60 having hollow rungs 63. The secondary attachment members 40 are attached to the side rails 61, 62 of the ladder 60 via threaded rod 44 (e.g. a long bolt) and mating nuts 45. Rod 44 traverses a hollow interior of an entire length of a ladder rung 63. Tightening nut 45 secures the secondary attachment members 40 to adjacent side rail 61. Passing rod 44 through a hollow interior of the ladder rung 63 is an easy and convenient means for attaching the secondary attachment member 40 to the ladder, in particular for ladders having open ended rungs 63 with access to the hollow interior of the rung from the side rails. Aluminium, fibreglass and composite ladders commonly have access to a hollow interior of a rung. Rod 44 may refer to an axle, shaft, wand, staff, pole, dowel, spike or other such member either hollow or solid and composed of any material. Rod 44 is shown as a solid metal.

For ladders without direct access to the hollow interior of the rung, for example some fibreglass ladders, an aperture may be drilled in the side rails 61, 62 of the ladder 60 to provide access to the hollow interior of the ladder rung 63. For a ladder without a rung having a hollow interior, for example some wood ladders, an aperture may be drilled from the side rail 61, through the ladder rung 63 and through opposite side rail 62 to thereby form a passage of the rod 44.

Adjacent to each secondary attachment member 40 is an optional support plate 48 located between the ladder side rail and each secondary attachment member 40. Support plate 48 is included in a preferred embodiment to provide a backing plate for each secondary attachment member 40 and is formed of a rigid material such a metal, fibreglass or composite material. The support plate 48 may be included when securing the secondary attachment member 40 to any type of ladder, for example, fibreglass, wood, plastic and metal. The support plate 48 is attached to the ladder side rail 61 via rivets, not shown, and is also retained by rod 44.

Each support apparatus 10 and 110 comprises a body 11, each comprising a fixed component 20 shown as a continuously enclosed elongate tubular housing through which a moveable component 30 moves relative to the fixed component 20. The moveable component 30 is shown as an inner extendable member that telescopically extends by sliding within the fixed component 20, as shown by the double headed arrows. The fixed component 20 is shown having a square cross-section and the moveable component 30 has a complementary shape to allow for the moveable component 30 to slide within the fixed component 20. The fixed component 20 guides the moveable component 30 in a linear longitudinal direction relative to the fixed component 20.

Fixed component 20 also comprises a securing means for securing the moveable component 30 relative to the fixed component 20. The securing means is provided as a securing member 24 comprising a securing pin 28 that is insertable into one of a plurality of respective complementary apertures 31 located on the moveable component 30. The securing member 24 is generally described in PCT/AU02/00080, incorporated herein by reference. When the securing pin 28 is inserted into an aperture 31, the moveable component 30 is secured at a desired length extending outward relative to the fixed component 20. To adjust the moveable component 30 to a different length, securing pin 28 is pulled out and removed from the complementary aperture 31 thereby allowing the moveable component 30 to telescopically move within fixed component 20 to a new length relative to the fixed component 20. A plurality of complementary apertures 31 are linearly arranged along moveable component 30 to provide different securable lengths. Spacing between adjacent apertures 31 provides an incremental adjustment in extended length of the moveable component 30. Accordingly, the spacing may be selected by a skilled person. Securing pin 28 is biased for insertion into a complementary aperture 31 using a compression coil spring.

The support apparatus 10 comprises the securing member 24 orientated on the fixed component 20 such that it extends perpendicular to the rungs 63 as shown in FIG. 1. This allows for easy access by a user who will typically face the ladder at an angle wherein the securing member 24 faces the user. Accordingly, for this embodiment support apparatuses attached to the right side rail and left side rail are mirror images.

The support apparatus 110 comprises the securing pin 24 located on a side of the fixed component 20 opposite pegs 122. This embodiment allows for the same support apparatus 110 to be attached to either right or left side rail of the ladder with the securing member facing away from the ladder side rail when attached to either right or left side rail.

Moveable component 30 comprises a support foot 32 that is pivotable relative to a bottom part of moveable component 30. Pivoting of the support foot 32 allows for the support foot 32 to contact a surface substantially flush or even and allows for the ladder 60 to lean at an angle relative to the surface. It will be appreciated that the support foot 32 may be fixed at any angle and need not be pivotable for all embodiments. For embodiments wherein the adjustable length support is symmetrical, the support foot 32 is also preferably symmetrical and pivotable so that the support foot 32 may be placed even with the ground or surface when the adjustable length support is attached to either right or left side rail of the ladder and the ladder is positioned at an angle relative to a bottom surface. Further, the support foot 32 comprises grooves or a rough bottom to lessen unwanted movement of the feet relative to surface 30.

Figure 2:
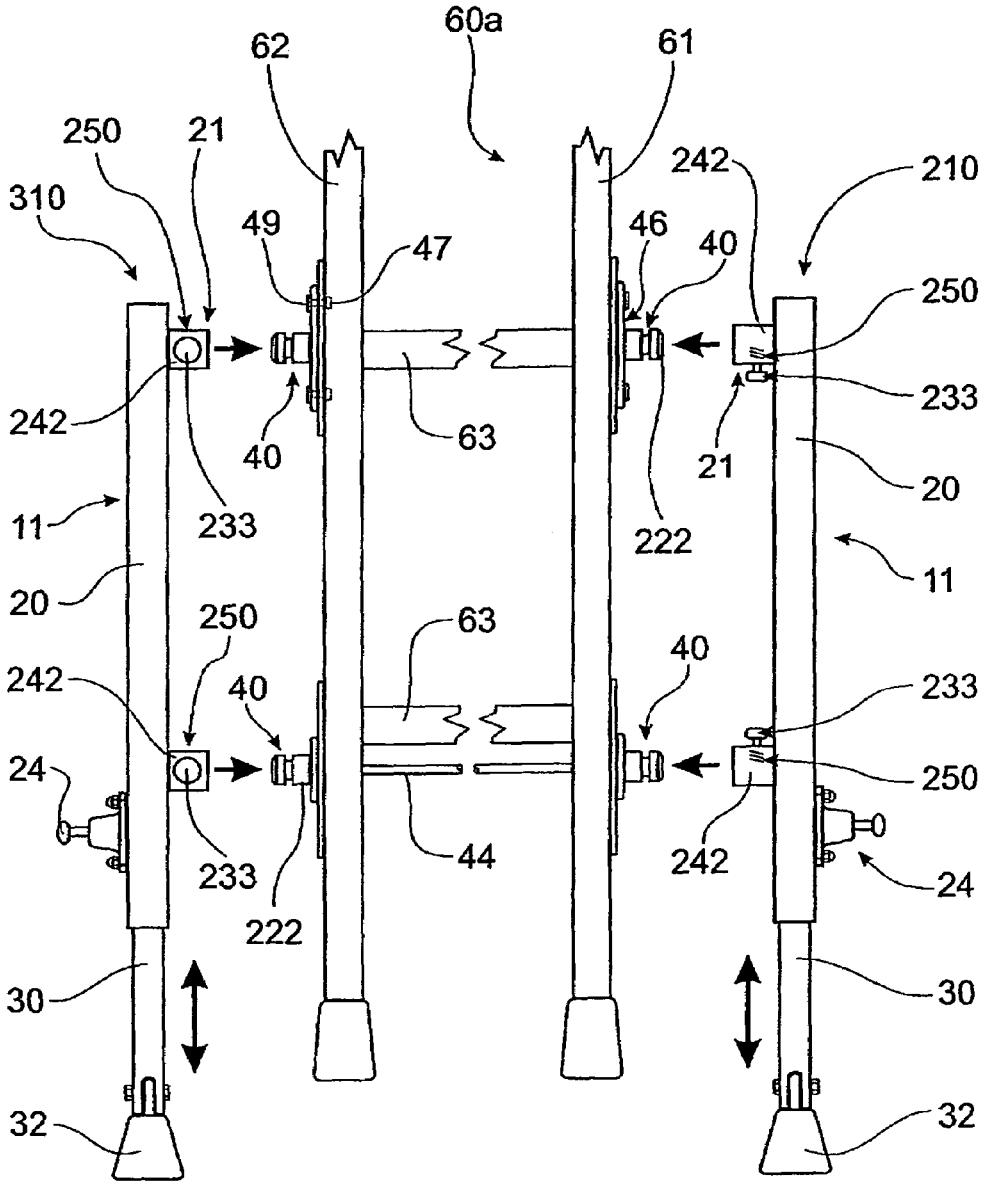
FIG. 2 is a front view showing other embodiments of the adjustable length supports and fasteners for securing a secondary attachment member to the ladder.

FIG. 2 shows a ladder 60*a* that does not comprise hollow rungs 63. A wood ladder commonly lacks hollow rungs, but ladders made of other materials may likewise lack hollow rungs. As shown for the bottom rung 63 in FIG. 2, the secondary attachment member 40 is secured to the ladder 60 by way of rod 44 that extends from side rail 61 to side rail 62 without passing though an interior of a ladder rung 63. For the embodiment wherein the rod 44 does not traverse an interior of a rung, aligned apertures may be drilled in both side rails of the ladder 60*a* so that the rod 44 may pass therethrough. It will be appreciated that embodiments including a rod 44 may provide additional strength to the support apparatus.

In an alternative embodiment shown on an upper portion of FIG. 2, the secondary attachment members 40 is secured to the side rails 61, 62 of a ladder 60 without rod 44. In this embodiment, a fastener 47 passes through an aperture 49 located on flange portion 46 of the secondary attachment member 40. The fastener 47 is shown as a rivet.

FIG. 2 also shows another embodiment of the support apparatus 210, wherein the primary attachment member 21 comprise a socket 242 and the secondary attachment member 40 comprise a peg 222. The peg 222 is attached to the ladder 60*a* in a similar manner as described for attaching a socket the ladder by way of a fastener such as a rod or rivet. The socket 242 is connected to a fixed component 20 of the body 221 of the support apparatus 210 by a weld. The peg 222 and socket 242 may be locked together in a similar manner as described in FIG. 1. The locking means 250 shown on the right side of FIG. 2 is similar to the locking means 150 shown in FIG. 1. However, the locking means 250 is located on the primary attachment member 21 connected to the support apparatus 210 rather than the secondary attachment member 40 secured to the ladder. Also, the location of the locking pin 233 is parallel with the fixed component 20 so that the support apparatus 210 is better adapted to be attached to either right or left side rail of the ladder.

The embodiment of the support apparatus 310 shown on the left side of ladder 60*a* in FIG. 2 is similar to support apparatus 210, however, the locking means 250 is oriented so that the locking pin 236 extends perpendicular to the socket 242 and thereby faces towards a user when in typical use.

Figure 3:
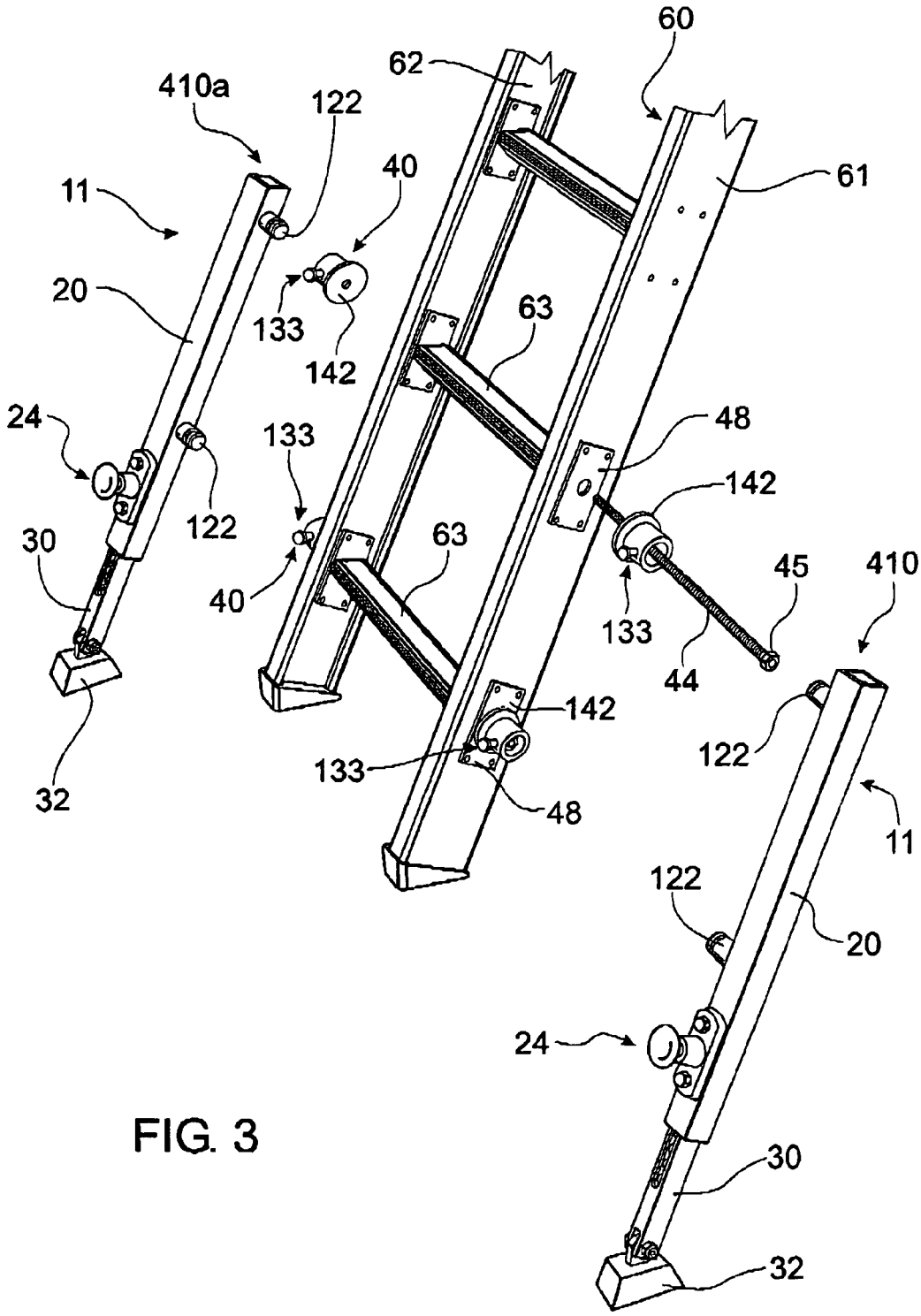
FIG. 3 is an isometric view of attaching two adjustable length supports to either side of a ladder.

FIG. 3 shows an embodiment of two support apparatus 410 and 410*a* that are mirror images of each other. The support apparatus 410, 410*a* are similar to the support apparatus 110 shown in FIG. 1, and each comprises a peg 122 welded to the fixed component 20 of the body 11. However, the securing member 24 is oriented facing perpendicular to the pegs 122 so that when the support apparatus 410, 410*a* are attached to the ladder 60, the securing pin faces the user and may be easily pulled to adjust the length of the moveable component 30. Also, the locking pin 133 of the locking means faces the user.

Figure 5:
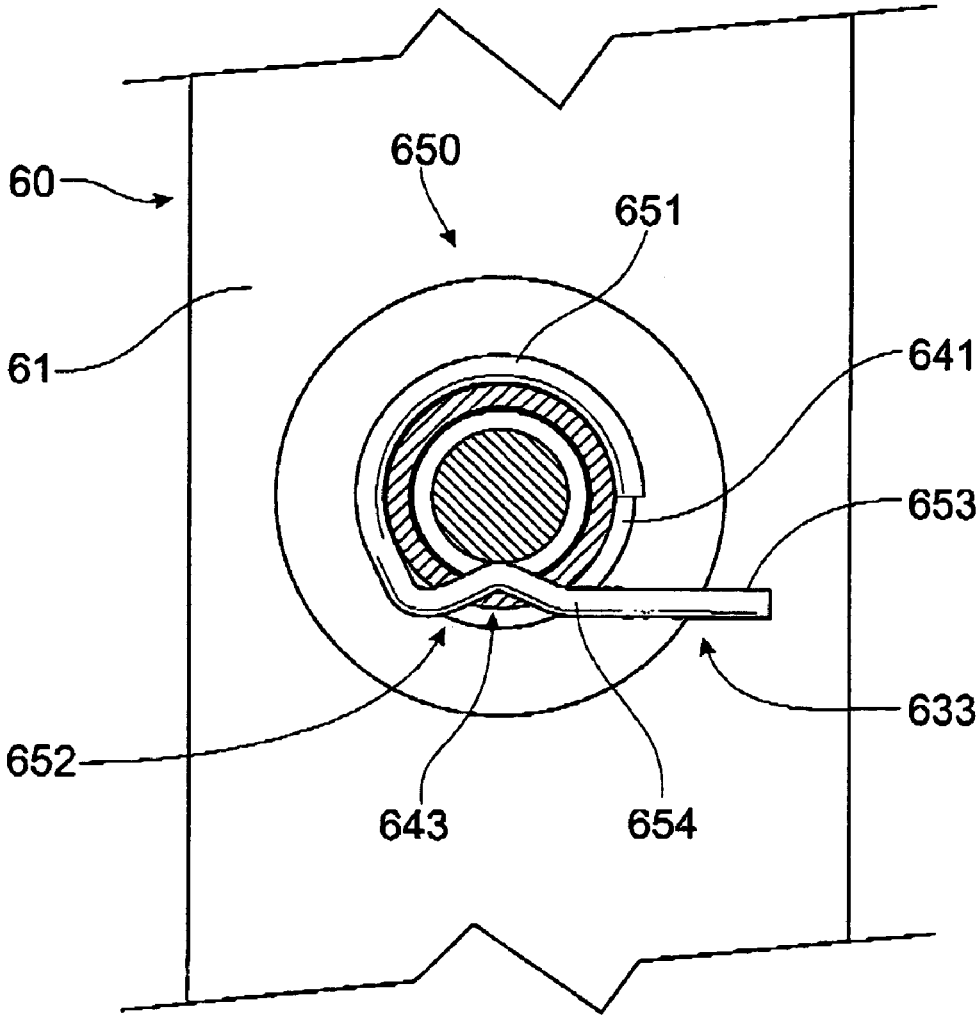
FIG. 5 is an end view of another embodiment of the secondary attachment member.

FIG. 5 illustrates another embodiment of the secondary attachment member 40 shown as a socket 642 that is secured to the side rail 61 of a ladder 60. The primary attachment member that mates with socket 642 comprises a peg 122 that is the same as that described in FIG. 1. In this embodiment, the socket 642 comprises a channel 641 extended substantially around a circumference of the socket 642 and adapted to receive a locking mean 650 in the form of a fastener comprising a locking ring 633. The locking ring 633 comprises a curved portion 651, a peg engaging portion 652 and an arm 653. The curved portion 651 assists with retaining the locking ring 633 within the channel 641. The peg engaging portion 652 is shown comprising a bent portion 654 that is insertable through an aperture 643 located in the channel 641. The arm 653 provides a leveraging point such that moving the arm 653 away from the curved portion 651 moves the bent portion 654 out from the aperture 643. The bent portion 654 is biased to extend through the aperture 643 and if the peg 122 is located within the socket 642, it will be locked therein.

In use, the support apparatus is attached to the ladder 60 by inserting the peg 122 into the socket 642. The bent portion 654 of the locking ring 633 is moved downward by pressing down on arm 653, the peg 122 is inserted into the socket 642 and the arm 653 is released so that the bent portion 654 inserts into the channel 123 thereby retaining the peg 122 and socket 642 together.

It will be appreciated that any combination of embodiments of primary attachment members and secondary attachment members is contemplated. Namely, when describing a preferred embodiment wherein a peg is located on the support apparatus and a socket is located on the ladder, the opposite arrangement is also contemplated and falls within the scope of the invention.

It will also be appreciated that the support apparatus of the invention may be symmetrical or non-symmetrical.

It will further be appreciated that embodiments of the peg comprising a groove that extends the circumference of the peg, for example groove 123 of peg 122, the groove may extend only on a part of the circumference of the peg, as long as the locking ring 633 or locking pin 133 can be secured therein.

The present invention provides an apparatus, assembly and method for attaching an item to a plurality of articles in a quick and easy manner. For example, a user may have several ladders, but only a single ladder may be used at a given time. If each ladder has a secondary attachment member secured thereto, the user needs to only purchase, store and/or transport a single or few adjustable length supports, which can be attached to the respective ladders when needed. Also, an ability to remove the adjustable length support from the ladder minimises damage to the adjustable length support during transport and storage. It is not uncommon for ladders attached to an exterior of a truck to experience damage during transport and when removing and placing the ladder on truck racks.

The primary attachment members 21, e.g. peg 22, 122 or socket 42, 142, 642 are shown welded to the fixed component of the body of the support apparatus. However, the peg or socket may be formed integral with the body, or may comprise a flange portion to provide a suitable location to fastening the peg or socket to the body, e.g. via a bolt, rivet, adhesive or otherwise fastener.

The pegs and sockets are shown cylindrical, but other shapes are contemplated, for example, square, rectangular, oval, hexagonal and the like. Also, other attachment members that preferably engage in a male-female interaction fall within the scope of the invention, for example, a bolt and nut, a peg and aperture and the like.

Although two primary attachment members 21 and two mating secondary attachment members 40 are preferred, other suitable number of attachment members may be included, for example, one, three and more. Preferably, the adjustable length support comprises at least two primary attachment members to prevent rotation of the adjustable support relative to the ladder.

It will be appreciated that the body of the support apparatus may have a cross sectional shape other than square, including for example, round, oval, hexagonal or other geometrical shape. It will also be appreciated that although the fixed component is shown preferably as a continuous elongate hollow housing, the fixed component may have other suitable forms capable of guiding the movement of the moveable component. For example, an open channel, bracket or other guiding means.

The moveable component is shown extending longitudinally from the fixed component and parallel relative to the side rail of the ladder. The fixed component is shown attached substantially parallel to the side rail, however, the fixed component may be mounted to either or both side rails at an angle other than 0° relative thereto, for example at 5°, 10°, 15°, 20° or other angle. It will be appreciated that in an embodiment wherein the moveable component extends parallel to the side rail of a ladder, the length of the moveable component is not limited as the moveable component will not be obstructed by the side rail when retracted. For the embodiment wherein the fixed component is attached to the side rail at an angle other than parallel or 0° relative to the side rail, the angle away from the adjacent side rail may provide lateral support for the ladder.

The present invention is not limited to the securing means described in the figures for adjusting and securing the moveable component relative to the fixed component. The abovementioned pin-and-aperture type securing member is merely one securing means which may be used. The moveable component may be secured relative to the fixed component by other means known in the art, including for example, by a plurality of teeth located on the moveable component and a pivotal pawl member located on the fixed component as described in AU 76668/81, herein incorporated by reference. Other useful securing means include a plurality of spaced-apart sloping teeth on the fixed component and a pin member located on the moveable component that is capable of engaging the teeth as described in U.S. Pat. No. 5,335,754 and a T-shaped gripping device having a sharp edge which contacts a smooth surface of an adjacent slidable rail as described in U.S. Pat. No. 4,802,471; both patents herein incorporated by reference. Other methods for extending and securing the moveable component, for example those methods described in U.S. Pat. Nos. 4,606,432 and 4,607,726 may be used, and both patents are herein incorporated by reference.

It will be appreciated that a fastener may comprise, for example, bolt, screw, rivet and adhesive fasteners such as epoxy and glues. A person skilled in the art would be able to select a suitable fastener and the invention is not limited to the preferred exemplified fastener.

Although the invention has been shown and described with exemplary embodiments thereof, it should be understood by those skilled in the art that the foregoing and various other changes, omissions and additions may be made therein and thereto without departing from the scope of the invention.

The disclosure of each patent and document referred to in this specification is incorporated by reference in its entirety.

What is claimed is:

1. A support or accessory apparatus for a ladder or scaffolding comprising:

(a) a fixed component;

(b) a movable component capable of telescopic movement relative to the fixed component and securable at a desired position relative thereto;

(c) a securing pin located on the fixed component and spring biased into a mating aperture or groove located on the movable component, wherein the securing pin when inserted into the mating aperture or groove secures the moveable component relative to the fixed component;

(d) a foot attached to the movable component and pivotable relative thereto;

(e) a primary attachment member connected to the fixed component;

(f) a secondary attachment member securable to the ladder or scaffolding and engageable in a peg-socket relationship with the primary attachment member; and (g) a lock comprising at least one fastener spring biased into a mating aperture or groove on at least one of the primary attachment member and secondary attachment member to thereby retain the primary attachment member and the secondary attachment member together, wherein the secondary attachment member is adapted to be secured to a side rail of the ladder and is secured by a second fastener that is adapted to extend at least through a side rail of the ladder and the second fastener is coupled to a rod adapted to traverse the ladder from one side rail to another side rail.

2. The support or accessory apparatus of claim 1 wherein the rod is adapted to be located within an adjacent rung of the ladder.

3. The support or accessory apparatus of claim 1 wherein the fixed component comprises a guiding means for guiding the movement of the movable component, wherein the guiding means is in the form of a housing, channel or at least one pair of brackets.

4. The support or accessory apparatus of claim 3 wherein the guiding means comprises a housing.

5. The support or accessory apparatus of claim 4 wherein the housing comprises an elongate continuous enclosed hollow tube.

6. The support or accessory apparatus of claim 1 wherein the primary attachment member is a socket and the secondary attachment member is a peg.

7. The support or accessory apparatus of claim 6 wherein the peg is slidable within the socket.

8. The support or accessory apparatus of claim 1 wherein the primary attachment member is a peg and the secondary attachment member is a socket.

9. The support or accessory apparatus of claim 1 wherein said at least one fastener comprises a locking pin coupled to a coiled spring, the coiled spring applying a force to bias the pin into the mating aperture or groove on at least one of the primary attachment member and secondary attachment member.

10. The support or accessory apparatus of claim 1 wherein the at least one fastener comprises a locking ring having a bent portion projecting inward towards the ring and adapted to be inserted through the mating aperture or groove in the primary attachment member or the secondary attachment member.

11. The support or accessory apparatus of claim 1, wherein the securing pin is coupled to a coiled spring, the coiled spring applying force to bias the securing pin into the mating aperture or groove located on the movable component.

12. A ladder or scaffolding assembly comprising:

(i) a ladder or scaffolding;

(ii) a support or accessory apparatus for a ladder or scaffolding comprising:

(a) a fixed component;

(b) a movable component capable of telescopic movement relative to the fixed component and securable at a desired position relative thereto;

(c) a securing pin located on the fixed component and spring biased to be inserted into a mating aperture or groove located on the movable component, wherein the securing pin when inserted into the mating aperture or groove secures the moveable component relative to the fixed component;

(d) a foot attached to the movable component and pivotable relative thereto;

(e) a primary attachment member connected to the fixed component;

(f) a secondary attachment member securable to the ladder or scaffolding and engageable in a peg-socket relationship with the primary attachment member; and (g) a lock comprising at least one fastener spring biased into a mating aperture or groove on at least one of the primary attachment member and secondary attachment member to thereby retain the primary attachment member and the secondary attachment member together, wherein the at least one fastener comprises a locking ring comprising a bent portion projecting inward towards the ring and is spring biased to be inserted through the mating aperture or groove on at least one of the primary attachment member and secondary attachment member.

13. The ladder or scaffolding assembly of claim 12 wherein the primary attachment member is a peg and the secondary attachment member is a socket.

14. The ladder or scaffolding assembly of claim 12, wherein the securing pin is coupled to a coiled spring, the coiled spring applying force to bias the securing pin into the mating aperture or groove located on the movable component.

15. The ladder or scaffolding assembly of claim 12 wherein the primary attachment member is a socket and the secondary attachment member is a peg.

16. A support or accessory apparatus for a ladder or scaffolding comprising:

(a) a fixed component;

(b) a movable component capable of telescopic movement relative to the fixed component and securable at a desired position relative thereto;

(c) a securing pin located on the fixed component and spring biased into a mating aperture or groove located on the movable component, wherein the securing pin when inserted into the mating aperture or groove secures the moveable component relative to the fixed component;

(d) a foot attached to the movable component and pivotable relative thereto;

(e) a primary attachment member connected to the fixed component;

(f) a secondary attachment member securable to the ladder or scaffolding and engageable in a peg-socket relationship with the primary attachment member; and (g) a lock comprising at least one fastener spring biased into a mating aperture or groove on at least one of the primary attachment member and secondary attachment member to thereby retain the primary attachment member and the secondary attachment member together, wherein the at least one fastener comprises a locking ring having a bent portion projecting inward towards the ring and adapted to be inserted through the mating aperture or groove in the primary attachment member or the secondary attachment member.

* * * * *

UNITED STATES PATENT AND TRADEMARK OFFICE

CERTIFICATE OF CORRECTION

PATENT NO. : 6,948,591 B2
APPLICATION NO. : 10/735529
DATED : September 27, 2005
INVENTOR(S) : Scott et al.

It is certified that error appears in the above-identified patent and that said Letters Patent is hereby corrected as shown below:

Cover Page,
Item (56), under "OTHER PUBLICATIONS", Jershon, Inc. change "http://jershon.com.index.html," to --http://www.jershon.com.index.html.,--
Item (57), under "ABSTRACT", line 2, change "such as a ladder" to --such as a ladder,--

Column 1,
Line 25, before "to be unstable" change "tend" to --tends--
Line 55, after "support apparatus" insert --,--

Column 2,
Line 1, change "comprises" to --comprise--
Line 8, change "comprises" to --comprise--
Line 19, after "pin" insert --,--
Line 19, after "mating apertures" insert --,--
Line 43, change "comprises" to --comprise--
Line 65, change "comprises" to --comprise--

Column 4,
Line 13, change "opposed" to --opposing--
Line 19, change "biased" to --biasing--
Line 24, change "biased" to --biasing--

Column 5,
Line 29, before "metal," change "a" to --as--

Column 6,
Line 55, change "comprise" to --comprises--
Line 56, change "comprise" to--comprises--
Line 60, change "body 221" to --body 11--

Column 7,
Line 3, before "right or left" insert --the--
Line 7, change "apparatus 210, however," to --apparatus 210. However,--
Line 29, change "locking mean" to --locking means--
Line 47, change "channel 123" to --channel 641--

UNITED STATES PATENT AND TRADEMARK OFFICE

CERTIFICATE OF CORRECTION

PATENT NO. : 6,948,591 B2
APPLICATION NO. : 10/735529
DATED : September 27, 2005
INVENTOR(S) : Scott et al.

It is certified that error appears in the above-identified patent and that said Letters Patent is hereby corrected as shown below:

Column 8,
Line 16, change “fastening” to --fasten--
Line 17, change “otherwise” to --other--

Signed and Sealed this

Tenth Day of April, 2007

JON W. DUDAS
*Director of the United States Patent and Trademark Office*